United States Patent [19]

Sprengel

[11] 4,363,410

[45] Dec. 14, 1982

[54] SPLIT TOPPING LIFT GEAR

[75] Inventor: Ernst-Helmuth Sprengel, Hamburg, Fed. Rep. of Germany

[73] Assignee: Blohm & Voss AG, Hamburg, Fed. Rep. of Germany

[21] Appl. No.: 204,192

[22] Filed: Nov. 5, 1980

[30] Foreign Application Priority Data

Nov. 8, 1979 [DE] Fed. Rep. of Germany ..... 2945012

[51] Int. Cl.[3] ..... B66C 23/52

[52] U.S. Cl. ..... 212/190; 212/262

[58] Field of Search ..... 212/190–194, 212/232, 233, 237, 239, 255, 262

[56] References Cited

U.S. PATENT DOCUMENTS 3,042,222 7/1962 Lehmann ..... 212/194

3,446,362 5/1969 Banks ..... 212/193

*Primary Examiner*—Robert G. Sheridan

*Attorney, Agent, or Firm*—Toren, McGeady and Stanger

[57] ABSTRACT

A split topping lift gear with a boom swingable through a plane between a pair of posts includes the boom and a jib hingedly connected to the upper end of the boom. The jib is elongated, with its hinged connection to the boom located between its ends. A relieving cargo tackle is connected to each end of the jib. One cargo tackle can be connected to the boom socket while the other is free to carry a load. The jib is adjustably positionable about its hinged connection in a vertical plane.

4 Claims, 2 Drawing Figures

SPLIT TOPPING LIFT GEAR

SUMMARY OF THE INVENTION

The present invention is directed to a split topping lift gear, especially for use on ships, and includes a cargo boom which can be swung through a plane extending between two posts.

The primary object of the present invention is to improve the utilization of such cargo-handling device and also for facilitating its use.

In accordance with the present invention, an elongated jib carrying relieving cargo tackle is hinged to the upper end of the boom at a point between its ends so that it can be moved through a vertical plane independently of the movement of the boom. Preferably, the jib is hinged to the boom at a point centered between its ends.

Similar jibs are known in cargo booms having only one topping lift, for example, in German Auslegeschrift No. 10 43 129, however, the movement of the jib in a vertical plane is always coupled with movement of the boom in the plane for guiding a single load acting on the jib in the same horizontal plane at any outreach. Therefore, the principle of operation of this known cargo boom and jib is different from the present invention.

In another arrangement, the jib involves a rigid or immovable boom extension. Such a jib is limited in its capacity because it is of the positive cantilever type. Further, the inclination of the jib cannot be adjusted independently of the boom.

As compared to this other arrangement, the movable jib of the present invention offers various advantages because of the many possibilities of its application. In accordance with the present invention, the movement of the jib can be effected hydraulically, as in German Auslegeschrift No. 10 43 129, and the relieving cargo tackle can be reconnected manually when the boom swings through the plane between the posts. With the hinged connection located centered between the ends of the jib, it is possible, in accordance with the present invention, to handle smaller or greater loads on the relieving cargo tackle when the jib is moved either to the left or the right of the plane of the posts.

In another embodiment of the invention, a complete cargo tackle is arranged at each of the opposite ends of the jib with the jib hinged to the boom at its center between the ends. In use, either one of the tackle can be fixed to the boom socket while the other serves for lifting a load.

As a result, as the boom is moved from one to the other sides of the plane through the posts, the use of the boom is significantly facilitated with regard to the handling of the relieving cargo tackle without impairing the mobility of the jib.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAIL DESCRIPTION OF THE INVENTION

Figure 1:
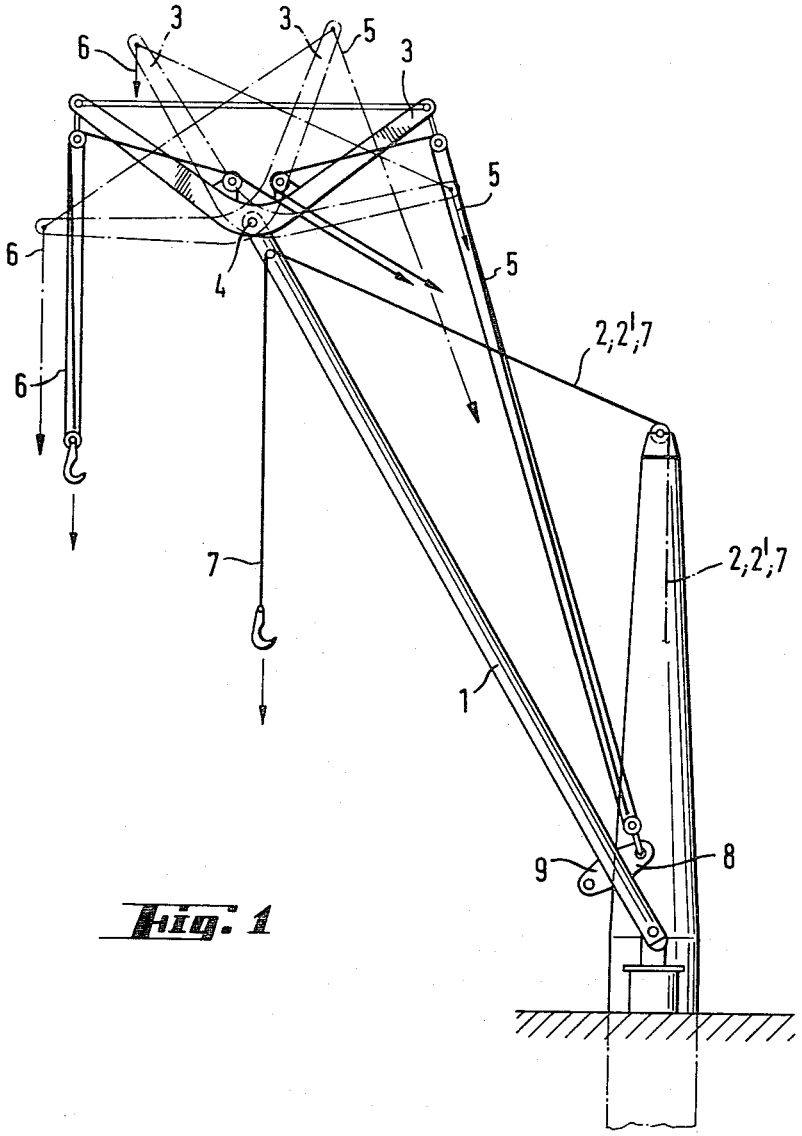
FIG. 1 is a schematic illustration of a split topping lift gear embodying the present invention with a movable top jib and two tackles connected to the boom with the boom being movable between a left position and a right position, and the boom is shown located above a left hatchway.
Figure 2:
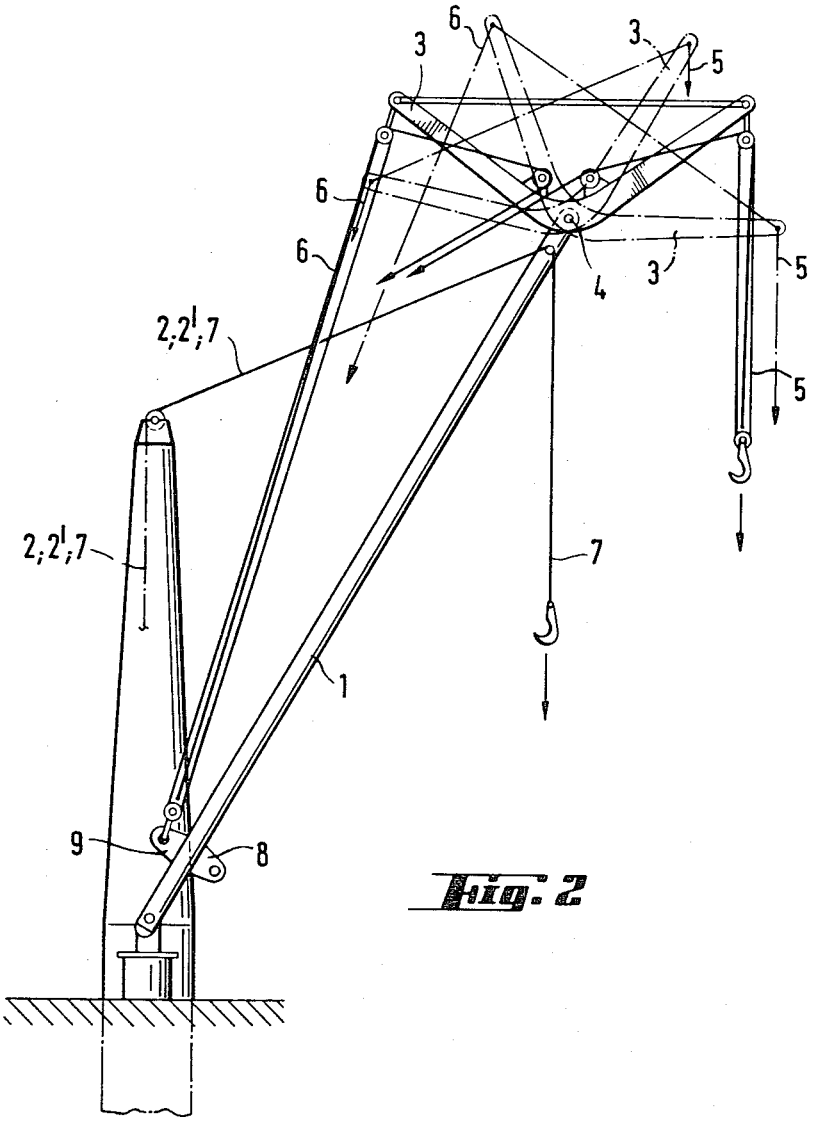
FIG. 2 is a schematic view, similar to FIG. 1, however illustrating the boom in a position located above a right hatchway, that is, to the right of the plane of the posts.

In FIGS. 1 and 2, a cargo boom 1 extends upwardly and a pair of span tackles 2, 2' are secured to the upper end of the boom. Above the connection point of the span tackles 2, 2' on the boom, a triangularly shaped top jib 3 is pivotally connected to the boom by a hinge 4. The hinge 4 is located above the connection of the main cargo tackle 7 at the upper end of the boom. The jib 3 is elongated with its hinged connection 4 being located approximately at the center between its ends in the elongated direction. Each end of the jib, that is, its left end and right end as viewed in the drawings, supports a different relieving cargo tackle 5, 6. A boom socket located adjacent the lower end of the boom 1 and having two socket parts 8, 9 each extending from an opposite side of the boom. When the boom is located to the left of the post, as shown in FIG. 1, the right-hand relieving cargo tackle 5 is fixed to the boom socket adjacent the lower end of the boom while the left-hand relieving cargo tackle 6 serves to support a load.

Each of the tackles 5, 6 can be operated by a winch drum. As shown in FIG. 1, using the right-hand tackle 5, the inclination of the jib can be adjusted under load as can its outreach. To swing the boom through the plane of the posts, the free tackle, in FIG. 1 the left-hand tackle 6, is released from the boom socket and is able to carry loads. As can be seen in FIG. 2, the arrangement of the left-hand and right-hand tackles 5, 6 can be reversed with the left-hand tackle 6 fixed to the boom socket part 9.

As mentioned above, FIG. 1 shows the boom 1 with the top jib 3 in the left-hand work range with the right-hand tackle 5 secured into the boom socket and the left-hand tackle 6 available to carry a load While specific embodiments of the invention have been shown and described in detail to illustrate the application of the inventive principles, it will be understood that the invention may be embodied otherwise without departing from such principles.

What is claimed is:

1. Split topping lift gear, such as used on ships, comprising a cargo boom swingable through a plane between a pair of posts, said boom having a lower end and an upper end, a jib hingedly connected to said boom adjacent the upper end thereof, said jib being elongated having a first end and a second end spaced apart in the elongated direction thereof and being connected to said boom at a position spaced from said first and second ends, a first relieving cargo tackle connected to the first end of said jib and a second relieving cargo tackle connected to the second end of said jib, said jib being movable in a vertical plane independently of the movement of said boom, a boom socket secured to said boom adjacent the lower end thereof, said boom socket having two parts each extending from an opposite side of said boom so that one of said first and second relieving tackles is fixed to one of said boom socket parts for adjusting the position of said jib and the other one of said first and second relieving cargo tackles is arranged to support a load.

2. Split topping lift gear, as set forth in claim 1, wherein the hinge connection of said jib to said boom is centered between said first and second ends thereof.

3. Split topping lift gear, as set forth in claim 1, wherein said jib being triangularly shaped.

4. Split topping lift gear, as set forth in claim 1, wherein a main cargo tackle being mounted on said boom adjacent the upper end thereof, and said jib being hingedly connected to said boom upwardly from the connection of said main cargo tackle.

* * * * *